US007113714B2

(12) United States Patent
Taguchi et al.

(10) Patent No.: US 7,113,714 B2
(45) Date of Patent: Sep. 26, 2006

(54) IMAGE FORMING APPARATUS AND METHOD HAVING MULTIPLE PRINT MODES

(75) Inventors: Keiichi Taguchi, Nagano-ken (JP); Kuniaki Tanaka, Nagano-ken (JP); Hiroshi Miyazawa, Nagano-ken (JP); Nobuyuki Mizushima, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 197 days.

(21) Appl. No.: 10/956,497

(22) Filed: Oct. 1, 2004

(65) Prior Publication Data

US 2005/0105938 A1 May 19, 2005

(30) Foreign Application Priority Data

Oct. 3, 2003 (JP) ..... 2003-345991

(51) Int. Cl.
*G03G 15/01* (2006.01)
*G03G 15/16* (2006.01)

(52) U.S. Cl. ..... 399/66; 399/302

(58) Field of Classification Search ..... 399/302, 399/313, 66

See application file for complete search history.

(56) References Cited

U.S. PATENT DOCUMENTS 6,078,777 A * 6/2000 Imumi et al. ..... 399/313
2002/0098011 A1* 7/2002 Tamiya et al. ..... 399/302

FOREIGN PATENT DOCUMENTS

| | | |
|---|---|---|
| EP | 0 760 495 | 3/1997 |
| EP | 1 280 012 | 1/2003 |
| JP | 61-029860 | 2/1986 |
| JP | 2001-092267 | 4/2001 |
| JP | 2001-154561 | 6/2001 |

* cited by examiner

*Primary Examiner*—Susan Lee
(74) *Attorney, Agent, or Firm*—Hogan & Hartson LLP

(57) ABSTRACT

In a monochromatic print mode, an abutting timing on when a secondary transfer roller abuts on an intermediate transfer belt is different from the timing in a color print mode. Specifically, in the monochromatic print mode, the secondary transfer roller abuts on the intermediate transfer belt prior to the start of an exposure process for the first image. Then, the secondary transfer roller is separated from the intermediate transfer belt at completion of the secondary transfer of the final image. Therefore, the secondary transfer roller has already abutted on the intermediate transfer belt at the start of the irradiation of a light beam for forming the first electrostatic latent image. The exposure process is performed with the secondary transfer roller kept abutting on the intermediate transfer belt.

7 Claims, 5 Drawing Sheets

IMAGE FORMING APPARATUS AND METHOD HAVING MULTIPLE PRINT MODES

CROSS REFERENCE TO RELATED APPLICATION

The disclosure of Japanese Patent Application No. 2003-345991 filed Oct. 3, 2003 including specification, drawings and claims is incorporated herein by reference in its entirety.

BACKGROUND OF THE INVENTION

1. Field of the Invention

The present invention relates to an image forming apparatus and method, wherein a color image or a monochromatic image is formed on an intermediate transfer medium and then, the image on the intermediate transfer medium is secondarily transferred to a recording medium such as a copy sheet, transfer sheet, paper sheet, or transparent sheet for OHP. In this apparatus, the color image is formed by superimposing a plurality of toner images in different colors on top of each other on the intermediate transfer medium such as a transfer belt, a transfer drum or a transfer sheet. Further, the monochromatic image is formed by transferring a monochromatic toner image to the intermediate transfer medium.

2. Description of the Related Art

In the image forming apparatus of this type, an electrostatic latent image is formed by irradiating a light beam on a latent image carrier such as a photosensitive member and a toner image is formed by developing the electrostatic latent image with toner. The toner image thus formed is primarily transferred to the intermediate transfer medium. Subsequently, the toner image is secondarily transferred to the recording medium at a suitable timing. In order to carry out the secondary transfer, a secondary transfer device, such as a secondary transfer roller, is provided being free to abut on or to be cleared from the intermediate transfer medium. And a timing on when the secondary transfer device abuts on the intermediate transfer medium is properly controlled (see, for example, Japanese Unexamined Patent Publication No. 2001-92267).

According to the apparatus disclosed in this Japanese Unexamined Patent Publication No. 2001-92267, a charging process by a charger roller is started at a proper timing and is followed by an exposure process, whereby the electrostatic latent image is formed on the photosensitive member. The electrostatic latent image is developed by a developing device containing a yellow toner, thereby forming a yellow toner image, which is primarily transferred to the intermediate transfer medium. Such an image forming process (exposure process—development process—primary transfer process) is repeatedly performed in the order of yellow, magenta, cyan and black, whereby a color image is formed on the intermediate transfer medium. The color image on the intermediate transfer medium is secondarily transferred to the recording medium by making the secondary transfer roller abut on the intermediate transfer medium in the course of performing the image forming process for the black toner.

SUMMARY OF THE INVENTION

The image forming apparatus operative to form the color image in the aforementioned manner is adapted to perform not only a color print mode to form the color image but also a monochromatic print mode to form a monochromatic image by executing the image forming process using the black toner alone. The image forming apparatus performs a secondary transfer process by making the secondary transfer roller abut on the intermediate transfer medium at a predetermined timing regardless of whether the operation is in the color print mode or in the monochromatic print mode. Therefore, the apparatus can only provide a control suited for either one of the color print mode and the monochromatic print mode. Hence, there still exists some points to be improved in this respect.

A primary object of the present invention is that in the image forming apparatus and method capable of selectively executing the color print mode and the monochromatic print mode, a timing on when the secondary transfer device abuts on the intermediate transfer medium is optimized in both of the print modes.

According to an aspect of the present invention, there is provided an image forming apparatus, comprising: a toner image forming section which performs an image forming process in which a toner image is formed by developing a latent image by means of one of plural developing devices that is selected to move to a predetermined development position, the plural developing devices containing toner of which toner colors different from each other respectively, the latent image formed by irradiating a light beam on a latent image carrier, and the toner image is primarily transferred to an intermediate transfer medium revolving in a fixed direction; a secondary transfer device which is free to be abutting on or cleared from the intermediate transfer medium and which secondarily transfers the toner image on the intermediate transfer medium to a recording medium in abutting on the intermediate transfer medium; and a controller which selectively executes a monochromatic print mode and a color print mode; the monochromatic print mode being a print mode to form a monochromatic image by making the toner image forming section perform the image forming process using toner of a specific color, and to secondarily transfer the monochromatic image to the recording medium by making the secondary transfer device abut on the intermediate transfer medium; the color print mode being a print mode to form a color image by making the toner image forming section perform the image forming process each time one of the plural developing devices is selected to form plural toner images and then superimposing the plural toner images on top of each other on the intermediate transfer medium, and to secondarily transfer the color image to the recording medium by making the secondary transfer device abut on the intermediate transfer medium, wherein a timing on when the secondary transfer device abuts on the intermediate transfer medium in the color print mode is different from the timing in the monochromatic print mode.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DETAILED DESCRIPTION OF THE PREFERRED EMBODIMENT

Figure 1:
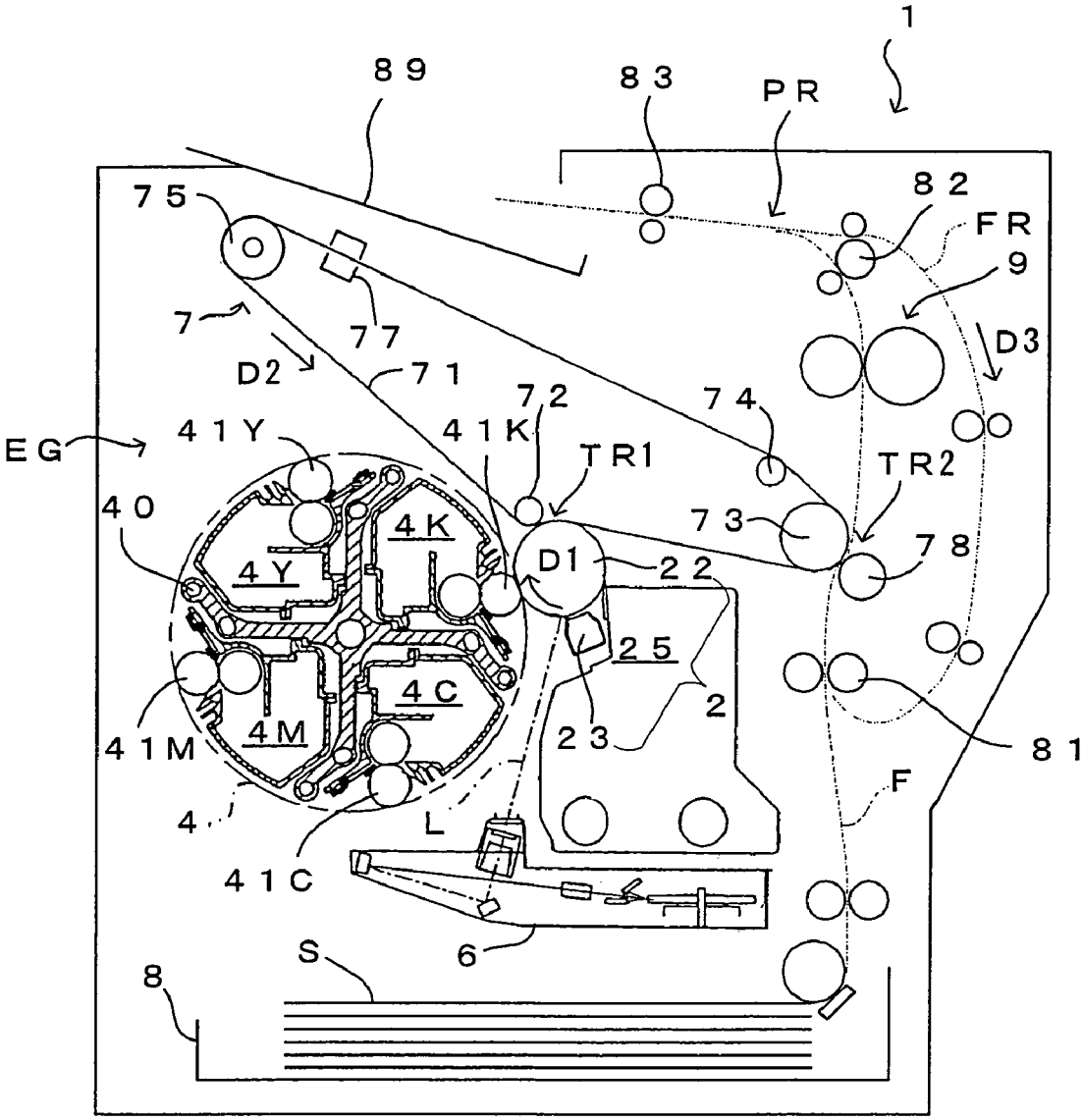
FIG. 1 is a diagram showing an image forming apparatus according to a preferred embodiment of the present invention.
Figure 2:
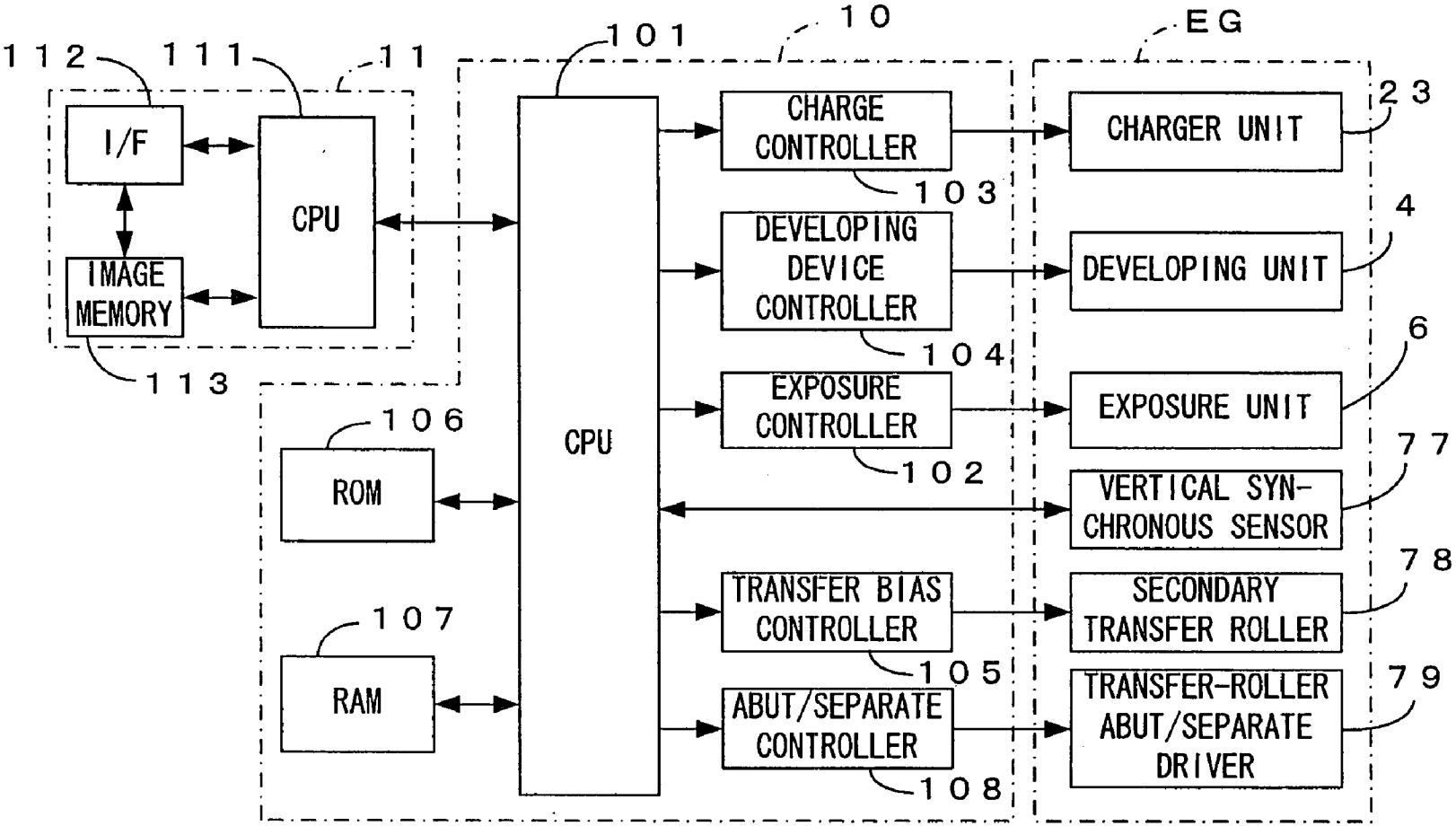
FIG. 2 is a block diagram showing an electric arrangement of the image forming apparatus of FIG. 1.

FIG. 1 is a diagram showing an image forming apparatus according to a preferred embodiment of the present invention. FIG. 2 is a block diagram showing an electric arrangement of the image forming apparatus of FIG. 1. The apparatus 1 is an image forming apparatus adapted to form a full color image by superimposing toner (developing agent) of four colors of yellow (Y), magenta (M), cyan (C) and black (K) (color print mode), and to form a monochromatic image using the toner of black (K) alone (monochromatic print mode). The image forming apparatus 1 operates as follows. When an external apparatus such as a host computer applies a print command signal including an image signal to a main controller 11 via an interface 112, a CPU 111 of the main controller 11 converts the print command signal into job data in a format suited for directing the operations of an engine EG and then outputs the resultant data to an engine controller 10. The engine controller 10, in turn, controls individual parts of the engine EG based on the job data sent from the CPU 111 so as to selectively carry out the color print mode or the monochromatic print mode for forming an image correspondent to the image signal on a recording medium S such as a copy sheet, transfer sheet, paper sheet, or transparent sheet for OHP.

The engine EG is provided with a photosensitive member 22 rotatable along a direction of an arrow D1 as seen in FIG. 1. A charger unit 23, a rotary developing unit 4 and a cleaner 25 are arranged around the photosensitive member 22 along the rotational direction D1 thereof. The charger unit 23 is applied with a charging bias from a charge controller 103 so as to uniformly charge an outer periphery of the photosensitive member 22 to a predetermined surface potential. The photosensitive member 22, the charger unit 23 and the cleaner 25 are integrated into a photosensitive member cartridge 2. The photosensitive member cartridge 2 is designed to be bodily mounted to or dismounted from a main body of the apparatus 1.

In the photosensitive member cartridge 2 mounted to the main body of the apparatus 1 in the aforementioned manner, an exposure unit 6 irradiates a light beam L onto the outer periphery of the photosensitive member 22 charged by the charger unit 23. The exposure unit 6 irradiates the light beam L on the photosensitive member 22 according to a control command applied from an exposure controller 102 so as to form an electrostatic latent image corresponding to the image signal. When the external apparatus such as a host computer applies the image signal to the CPU 111 of the main controller 11 via an interface (I/F) 112, a CPU 101 of the engine controller 10 outputs a control signal corresponding to the image signal to the exposure controller 102 at a predetermined timing. In response to the control signal, the exposure unit 6 irradiates the light beam L on the photosensitive member 22 so that the electrostatic latent image corresponding to the image signal is formed on the photosensitive member 22. Thus, according to the preferred embodiment, the photosensitive member 22 corresponds to a "latent image carrier" of the present invention.

The electrostatic latent image thus formed is developed into a toner image by means of the developing unit 4. In this embodiment, the developing unit 4 includes a support frame 40 adapted to rotate about an axis, a yellow developing device 4Y, a magenta developing device 4M, a cyan developing device 4C and a black developing device 4K. These developing devices 4Y, 4C, 4M, 4K are each designed to be removably mounted to the support frame 40 and each contain toner of respective color.

Based on a control command from a developing device controller 104 in the engine controller 10, the developing unit 4 is driven into rotation and when one of the developing devices 4Y, 4C, 4M, 4K is selectively positioned at a predetermined development position abutting against the photosensitive member 22 or facing the photosensitive member 22 via a predetermined gap therebetween, one of developing rollers 41Y, 41C, 41M, 41K of the developer positioned at the development position carrying thereon toner of selected color supplies the toner to the photosensitive member 22. Thus, the electrostatic latent image on the photosensitive member 22 is developed in a selected toner color.

The toner image developed by the developing unit 4 in the aforementioned manner is primarily transferred onto an intermediate transfer belt 71 of a transfer unit 7 in a primary transfer region TR1. The transfer unit 7 includes the intermediate transfer belt 71 entrained about a plurality of rollers 72–75, and a driver (not shown) operative to drive the roller 73 into rotation thereby driving the intermediate transfer belt 71 in revolution in a predetermined moving direction D2.

A transfer belt cleaner (not shown) and a vertical synchronous sensor 77 are disposed near the roller 75. The vertical synchronous sensor 77 is to detect a reference position of the intermediate transfer belt 71 and functions as a vertical synchronous sensor which acquires a synchronous signal outputted in relation to a revolution in sub scanning direction of the intermediate transfer belt 71, the synchronous signal being a vertical synchronous signal Vsync. In this apparatus, the operation of the individual parts is controlled based on the vertical synchronous signal Vsync for synchronizing the operation timing of the individual sections and for superposing the toner images of each color correctly. That is, the individual parts of the engine EG operate in synchronization with the vertical synchronous signal whereby an image forming process is carried out. The "image forming process" means a process to form the toner image by developing the latent image on the photosensitive member 22 by means of one of the developing devices 4Y, 4M, 4C, 4K that is selected to move to the development position and to transfer the toner image onto the intermediate transfer belt 71 that moves in the fixed moving direction D2. Thus, the image forming process is performed each time one of the developing devices 4Y, 4M, 4C, 4K is selected and toner images of four colors are superimposed on top of each other on the intermediate transfer belt 71 whereby a color image is formed (color print mode). The color image is formed in this manner and is secondarily transferred to the recording medium S taken out from a cassette 8 one by one and transported along a transportation path F to a secondary transfer region TR2.

In a case where a monochromatic image is secondarily transferred to the recording medium S, on the other hand, the monochromatic image is formed by performing the image forming process for black color (monochromatic print mode). Subsequently, the same procedure as that for the color image is taken to transfer the resultant monochromatic image to the recording medium S transported to the secondary transfer region TR2. Thus is obtained a print of the monochromatic image.

In this performance, a timing on when to feed the recording medium S to the secondary transfer region TR2 is controlled in order to ensure that the image on the intermediate transfer belt 71 is transferred exactly to a predetermined place on the recording medium S. Specifically, a gate roller 81 is provided on the transportation path F at a place upstream from the secondary transfer region TR2. The gate roller 81 is rotated in exact timing to the revolution of the intermediate transfer belt 71, thereby feeding the recording medium S to the secondary transfer region TR2 at a predetermined timing.

Figure 3:
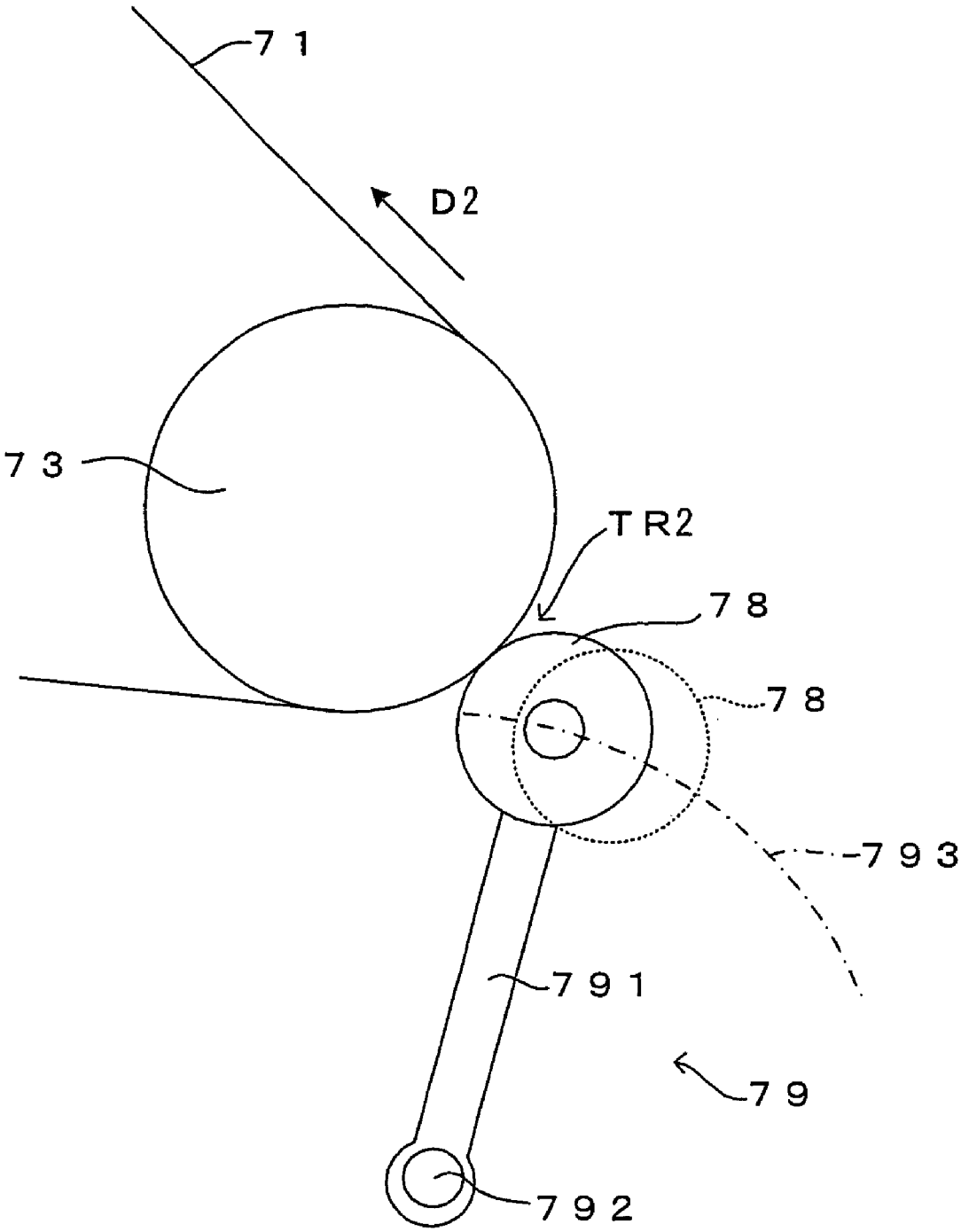
FIG. 3 is an enlarged view of a secondary transfer region.

FIG. 3 is an enlarged view of a secondary transfer region in the image forming apparatus of FIG. 1. In the secondary transfer region TR2, a secondary transfer roller 78 is disposed facing the driving roller 73 in a manner to sandwich a transportation path F of the recording medium S. The secondary transfer roller 78 is adapted to abut on or separate from the intermediate transfer belt 71 by means of a transfer-roller abut/separate driver 79. The transfer-roller abut/separate driver 79 is electrically connected to an abut/separate controller 108. In response to a control command from the abut/separate controller 108, a rocking arm 791 is driven into rocking motion about a pivot 792. The secondary transfer roller 78 is rotatably supported by the rocking arm 791 at an end of the rocking arm 791. In conjunction with the rocking motion of the rocking arm 791, the secondary transfer roller 78 moves reciprocatory along an arcuate trajectory 793. Thus, when the rocking arm 791 moves toward the intermediate transfer belt 71, the secondary transfer roller 78 abuts on the intermediate transfer belt 71 and rotates following the revolution of the intermediate transfer belt 71. Then, with the secondary transfer roller 78 abutting on the intermediate transfer belt 71, a transfer bias is applied from a transfer bias controller 105 to the secondary transfer roller 78 thereby secondarily transferring the image to the recording medium S. When the rocking arm 791 moves away from the intermediate transfer belt 71, on the other hand, the secondary transfer roller 78 separates from the intermediate transfer roller 71.

Referring back to FIG. 1, the recording medium S with the color image or the monochromatic image thus secondarily transferred is transported to a discharge tray 89 via a fixing unit 9, a pre-discharge roller 82 and a discharge roller 83, the discharge tray 89 disposed on an upper side of the main body. In a case where the image is formed on both sides of the recording medium S, the rotation of the discharge roller 83 is reversed at a point of time that a trailing end of the recording medium S thus formed with the image on one side thereof is transported to a reversal position PR, so that the recording medium S is transported along a reversal transportation path FR in a direction of an arrow D3. Thereafter, the recording medium S is loaded again on the transportation path F at a place upstream from the gate roller 81. At this time, the recording medium S is positioned in a manner that its side opposite from the side previously formed with the image abuts on the intermediate transfer belt 71 in the secondary transfer region TR2 so as to be transferred with the image. In this manner, the image may be formed on the both sides of the recording medium S.

In FIG. 2, a reference numeral 113 represents an image memory provided in the main controller 11 in order to store the image supplied from the external apparatus, such as a host computer, via the interface 112. A reference numeral 106 represents a ROM for storage of an operation program executed by the CPU 101 and control data used for controlling the engine EG. A reference numeral 107 represents a RAM for temporary storage of operation results given by the CPU 101 and other data.

Figure 4:
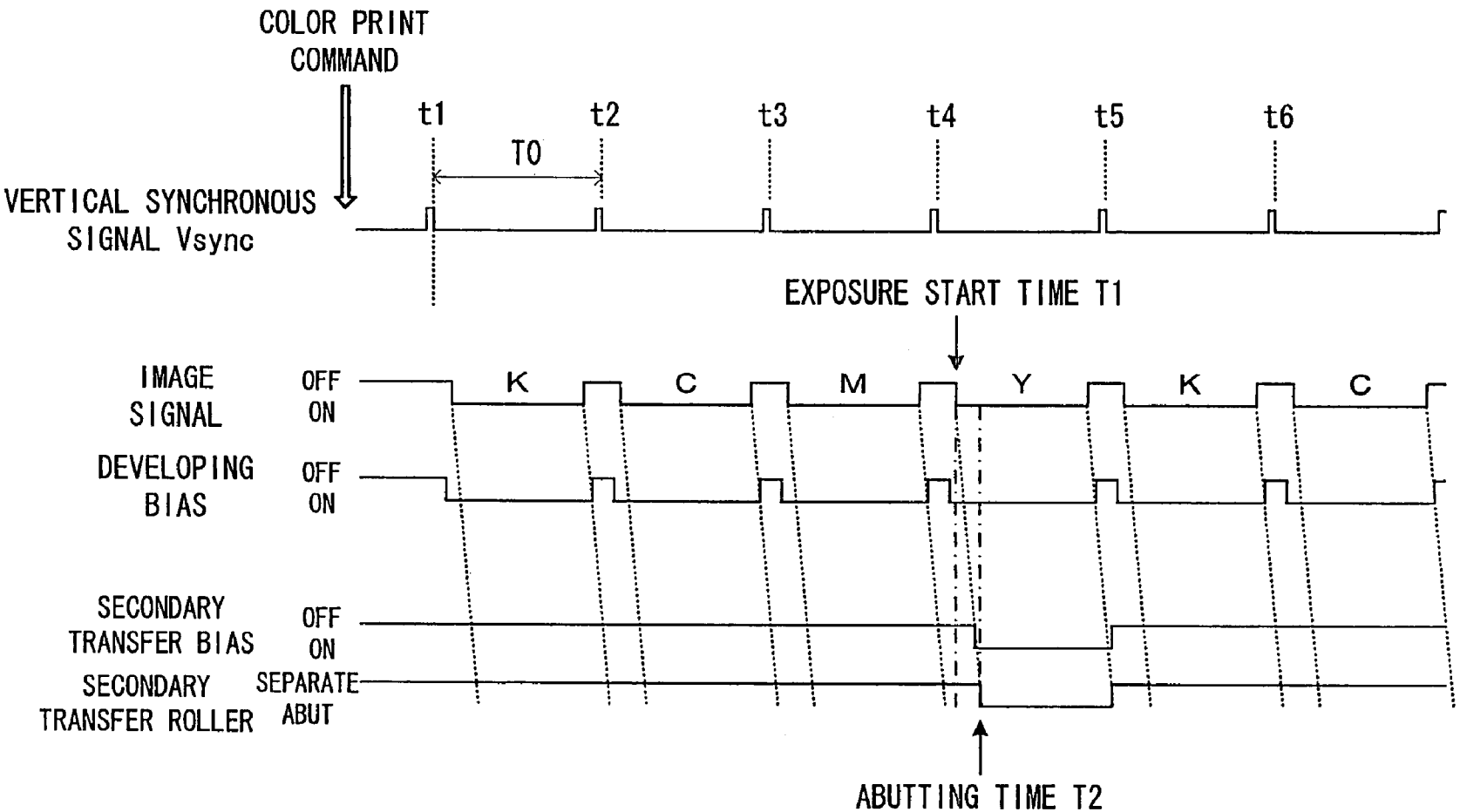
FIG. 4 is a timing chart illustrating an operation of the image forming apparatus of FIG. 1.
Figure 5:
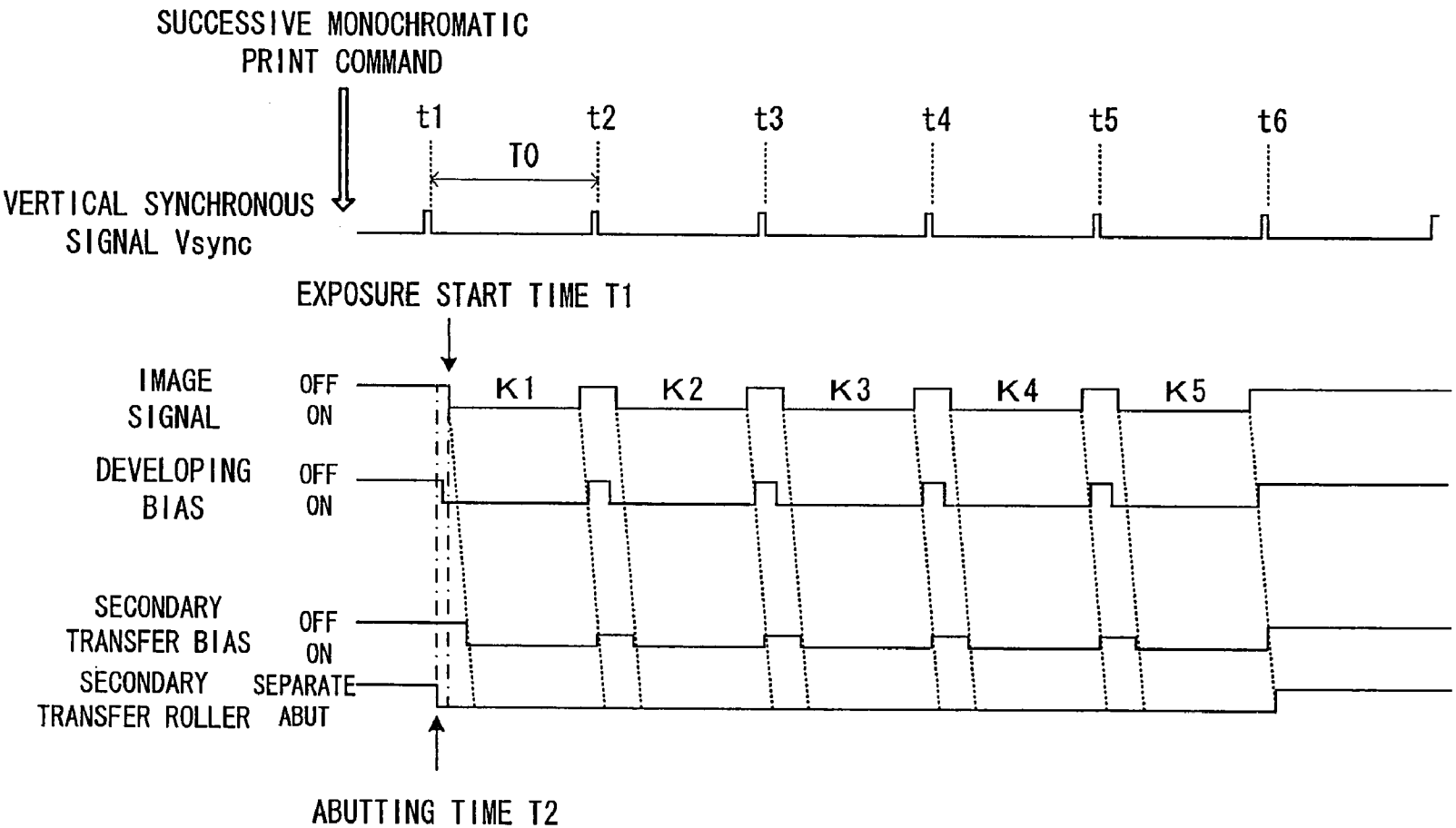
FIG. 5 is a timing chart illustrating another operation of the image forming apparatus of FIG. 1.

FIGS. 4 and 5 are timing charts each illustrating an operation of the image forming apparatus of FIG. 1. In this image forming apparatus, either the color print mode or the monochromatic print mode is performed according to the print command applied from the external apparatus. In the interest of clarity of the features of the present invention, a description is made on separate cases which include: (a) a case where a color print command for successively making prints of an A3-size color image is applied from the external apparatus; and (b) a case where a monochromatic print command for successively making prints of an A3-size monochromatic image is applied from the external apparatus.

(a) Color Print Mode

When the aforesaid color print command is applied from the external apparatus, the main controller 11 converts the color print command into job data in a format suited for directing the operations of the engine EG and then, sends the job data to the engine controller 10. The engine controller 10, in turn, controls the individual parts of the engine EG based on the job data sent from the CPU 111, so that a color image is formed on the intermediate transfer belt 71. Specifically, the color image is formed by performing: (a-1) an image forming process to form a black toner image; (a-2) an image forming process to form a cyan toner image; (a-3) an image forming process to form a magenta toner image; and (a-4) an image forming process to form a yellow toner image.

(a-1) Image Forming Process to Form Black Toner Image

In this process, the black developing device 4K is selected to move to the development position. Further, an electrostatic latent image for black color is formed on the photosensitive member 22 and then is developed by the developing device 4K thereby forming a toner image, which is transferred onto the intermediate transfer belt 71 moving in the moving direction D2. Thus, the black toner image is carried on the intermediate transfer belt 71. In the latter half of this image forming process, movement of a switch to the developing device 4C of the next toner color is started.

(a-2) Image Forming Process to Form Cyan Toner Image

When the cyan developing device 4C is selected to move to the development position, the rotational driving of the developing unit 4 stops. Further, an electrostatic latent image for cyan color is formed on the photosensitive member 22 and then is developed by the developing device 4C thereby forming a toner image, which is transferred onto the intermediate transfer belt 71 in a manner to be superimposed on the black toner image formed in the preceding process (a-1). In the latter half of this image forming process, movement of a switch to the developing device 4M of the next toner color is started.

(a-3) Image Forming Process to Form Magenta Toner Image

When the magenta developing device 4M is moved to the development position, the rotational driving of the developing unit 4 is stopped. Further, an electrostatic latent image for magenta color is formed on the photosensitive member 22 and then is developed by the developing device 4M thereby forming a toner image, which is transferred onto the intermediate transfer belt 71 in a manner to be superimposed on the toner images formed in the preceding processes (a-1), (a-2). In the latter half of this image forming process, movement of a switch to the developing device 4Y of the next toner color is started.

(a-4) Image Forming Process to Form Yellow Toner Image

When the yellow developing device 4Y is moved to the development position, the rotational driving of the developing unit 4 is stopped. Further, the light beam L is irradiated on the photosensitive member 22 at a predetermined exposure start time T1, so as to form an electrostatic latent image corresponding to an image signal Y The resultant latent image is developed by the developing device 4Y thereby forming a toner image, which is transferred onto the intermediate transfer belt 71 in a manner to be superimposed on the toner images formed in the preceding processes (a-1) through (a-3). These four image forming processes are repeated so as to superimpose the toner images of the four colors on top of each other on the intermediate transfer belt 71, whereby the color image is formed.

(a-5) Secondary Transfer Process

In the color print mode, the secondary transfer roller 78 is positioned at a separating position (indicated by a broken line in FIG. 3) so as to be separated from the intermediate transfer belt 71 before the image forming process is started and while the image forming processes (a-1) through (a-3) are performed. In the course of performing the last image forming process (a-4), the secondary transfer roller 78 is positioned at an abutting position (indicated by a solid line in FIG. 3) and a secondary transfer bias is applied to the secondary transfer roller 78 to perform a secondary transfer process. More specifically, after the start of the image forming process (a-4), in synchronization with the arrival at the secondary transfer region TR2 of a leading end of the color image formed on the intermediate transfer belt 71, the secondary transfer roller 78 is moved to the abutting position at an abutting time T2 to press the recording medium S delivered by the gate roller 81 against the intermediate transfer belt 71 and the secondary transfer bias is applied to the secondary transfer roller 78. Thus, the color image is transferred to the recording medium S.

According to the preferred embodiment, the secondary transfer roller 78 is moved to the intermediate transfer belt 71 to abut on the intermediate transfer belt 71 in the course of performing the last image forming process (a-4), in other words, in the course of irradiating the light beam on the photosensitive member 22. Therefore, it is impossible to eliminate the adverse effect of the abutting of the secondary transfer roller 78 on the intermediate transfer belt 71 completely.

The "effect of the abutting of the secondary transfer roller 78 (secondary transfer device) on the intermediate transfer belt 71 (intermediate transfer medium)" includes displacement of an exposure position of the light beam (hereinafter, referred to as "banding"). The followings are thought to be causative factors of the banding. When the secondary transfer roller 78 abuts on the intermediate transfer belt 71, for example, load on the intermediate transfer belt 71 is varied so that the moving speed of the intermediate transfer belt 71 is varied. The varied moving speed of the intermediate transfer belt 71 affects the photosensitive member 22 (latent image carrier) via the primary transfer region TR1 where the primary transfer of the toner image is carried out. Thus, the moving speed of the photosensitive member 22 is also varied.

Furthermore, when the secondary transfer roller 78 abuts on the intermediate transfer belt 71, a frame retaining individual parts of the apparatus encounters vibrations, which may affect to vary the moving speed of the photosensitive member 22. Thus, if the secondary transfer roller 78 abuts on the intermediate transfer belt 71 during the irradiation of the light beam (exposure process) to cause the variation of the moving speed of the photosensitive member 22, the banding occurs.

As described above, according to the preferred embodiment, the secondary transfer roller 78 abuts on the intermediate transfer belt 71 in the course of irradiating the light beam on the photosensitive member 22. Therefore, it is impossible to eliminate the adverse effect of the banding completely. On this account, the embodiment specifies the yellow toner as the toner to be used in the last image forming process (a-4), the yellow toner the least perceptible to the human eyes among the four toner colors (Y, M, C, K). Thus, the adverse effect of the banding may be minimized even if a part of the yellow toner image should suffer density variations because of the banding.

(b) Monochromatic Print Mode

When the aforesaid monochromatic print command is applied from the external apparatus, the main controller 11 converts the monochromatic print command into job data in a format suited for directing the operations of the engine EG and then, sends the job data to the engine controller 10. The engine controller 10, in turn, controls the individual parts of the engine EG based on the job data sent from the CPU 111, so that a monochromatic image is formed on the intermediate transfer belt 71. Specifically, with the black developing device 4K moved to the development position, an image forming process to be described below is repeated five times for successively forming five monochromatic images.

Each of the image forming processes forms a single monochromatic image. More specifically, the image forming process of the first time is performed the same way as the aforementioned image forming process (a-1) so as to form a monochromatic image. That is, an electrostatic latent image for black color is formed on the photosensitive member 22 and then is developed by the developing device 4K thereby forming a toner image, which is transferred to the intermediate transfer belt 71 moving in the moving direction D2. Thus, the black toner image is formed as the first monochromatic image on the intermediate transfer belt 71. The subsequent image forming processes are performed the same way, thereby forming monochromatic images, respectively.

According to the embodiment, the timing on when the secondary transfer roller 78 abuts on the intermediate transfer belt 71 is different from the timing in the color print mode (a). Namely, in the monochromatic print mode, as shown in FIG. 5, the secondary transfer roller 78 abuts on the intermediate transfer belt 71 at an abutting time T2 earlier than an exposure start time T1 for the first image formation. In addition, the secondary transfer roller 78 is separated from the intermediate transfer belt 71 at completion of the secondary transfer of the final image. Accordingly, the secondary transfer roller 78 has already abutted on the intermediate transfer belt 71 when the irradiation of the light beam is started in the monochromatic print mode of the first time. Thus, the exposure process is performed with the secondary transfer roller 78 kept abutting on the intermediate transfer belt 71, so that the occurrence of the banding may effectively be prevented. Further, during the second and the succeeding image formation, the secondary transfer roller 78 is kept abutting on the intermediate transfer belt 71 since the first image formation. It is thus ensured that the occurrence of the banding is prevented. As apparent from comparison between FIG. 4 and FIG. 5, in this embodiment, the timing on when the secondary transfer roller 78 abuts is varied depending upon the print mode and accordingly, the timing on when to apply the secondary transfer bias is also varied depending upon the print mode.

According to the preferred embodiment, as described above, the image forming apparatus capable of selectively executing the color print mode and the monochromatic print mode is arranged such that the timing on when the secondary transfer device abuts on the intermediate transfer medium is varied depending upon the print mode. Hence, the apparatus is capable of making the secondary transfer roller 78 abut on the intermediate transfer belt 71 at an abutting time suited for each print mode. Accordingly, the effect of the abutting of the secondary transfer roller 78 on the intermediate transfer belt 71 may be optimized in each print mode, thereby ensuring that a good image is formed.

According to the preferred embodiment, in particular, the secondary transfer roller 78 is disposed such that a tangential direction of the trajectory 793 is oriented downward with respect to a rotational center of the roller 73 when the secondary transfer roller 78 abuts on the intermediate transfer belt 71. Thus, the embodiment adopts an arrangement in which the roller 73 is moved upward when the secondary transfer roller 78 abuts on the intermediate transfer belt 71, so that the intermediate transfer belt 71 is prone to speed variations. Hence, a significant merit is afforded by adopting the arrangement of the present invention.

It is to be noted that the invention is not limited to the foregoing embodiment and various other changes than the above may be made so long as such changes do not depart from the scope of the present invention. For example, while a plurality of images are successively printed in the foregoing embodiment, it goes without saying that a similar effect may be obtained in a case where the printing operation is performed one by one. Further, while the foregoing embodiment forms a single image on the intermediate transfer belt 71, the present invention is also applicable to an image forming apparatus adapted to form a plurality of images on the intermediate transfer belt 71.

Further, although the foregoing embodiment employs the intermediate transfer belt 71 as the intermediate transfer medium, the intermediate transfer medium is not limited to this. The present invention is also applicable to an image forming apparatus which employs, for example, an intermediate transfer drum or intermediate transfer sheet as the intermediate transfer medium.

Further, although the foregoing embodiment employs the secondary transfer roller 78 as the secondary transfer device, the secondary transfer device is not limited to this. The present invention is also applicable to an image forming apparatus which employs, for example, a belt-type secondary transfer device.

Further, while the foregoing embodiment adopts the rotary drive system for selectively moving any one of the four developing devices 4Y, 4M, 4C, 4K to the predetermined development position, the number of developing devices is not limited to "four". The present invention may be applied to all kinds of image forming apparatuses adapted for the movement of two or more developing devices. Furthermore, the drive system of the developing unit is not limited to the rotary system. The present invention is also applicable to an image forming apparatus in which the movement of the developing devices is accomplished by selectively transporting any one of the developing devices to the development position.

Further, in the foregoing embodiment, the monochromatic image is formed using the black toner specified as the toner of a "specific color" of the present invention. However, the present invention is also applicable to an image forming apparatus in which a monochromatic image is formed using toner of another color specified as the "specific color" of the present invention. Furthermore, the image forming apparatus includes all types of image forming apparatuses such as copiers and facsimile machines.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image forming apparatus, comprising:

a toner image forming section which performs an image forming process in which a toner image is formed by developing a latent image by means of one of plural developing devices that is selected to move to a predetermined development position, said plural developing devices containing toner of which toner colors different from each other respectively, the latent image formed by irradiating a light beam on a latent image carrier, and the toner image is primarily transferred to an intermediate transfer medium revolving in a fixed direction;

a secondary transfer device which is free to be abutting on or cleared from said intermediate transfer medium and which secondarily transfers the toner image on said intermediate transfer medium to a recording medium in abutting on said intermediate transfer medium; and a controller which selectively executes a monochromatic print mode and a color print mode; said monochromatic print mode being a print mode to form a monochromatic image by making said toner image forming section perform said image forming process using toner of a specific color, and to secondarily transfer the monochromatic image to said recording medium by making said secondary transfer device abut on said intermediate transfer medium; said color print mode being a print mode to form a color image by making said toner image forming section perform said image forming process each time one of said plural developing devices is selected to form plural toner images and then superimposing the plural toner images on top of each other on said intermediate transfer medium, and to secondarily transfer the color image to said recording medium by making said secondary transfer device abut on said intermediate transfer medium, wherein a timing on when said secondary transfer device abuts on said intermediate transfer medium in said color print mode is different from said timing in said monochromatic print mode.

2. The image forming apparatus of claim 1, wherein said controller, in said monochromatic print mode, makes said secondary transfer device abut on said intermediate transfer medium prior to the formation of the latent image by irradiation of the light beam.

3. The image forming apparatus of claim 1, wherein said controller, in a case where said monochromatic print mode is executed in succession, makes said secondary transfer device abut on said intermediate transfer medium prior to the formation of the latent image by irradiation of the light beam in said monochromatic print mode of the first time, and keeps said secondary transfer device abutting on said intermediate transfer medium till the completion of said monochromatic print mode of the last time.

4. The image forming apparatus of claim 1, wherein said controller, in said color print mode, makes said secondary transfer device abut on said intermediate transfer medium while said toner image forming section is performing the last one of the plural image forming processes for forming the color image, and a color of toner used in said last image forming process is the least perceptible to the human eyes among the toner colors.

5. The image forming apparatus of claim 1, wherein said secondary transfer device is a roller free to follow the revolution of said intermediate transfer medium.

6. The image forming apparatus of claim 5, wherein said roller reciprocatory moves along a predetermined arcuate trajectory thereby abutting on or separating from said intermediate transfer medium.

7. An image forming method of forming an image by performing an image forming process in which a toner image is formed by developing a latent image by means of one of plural developing devices that is selected to move to a predetermined development position, said plural developing devices containing toner of which toner colors different from each other respectively, the latent image formed by irradiating a light beam on a latent image carrier, and the toner image is primarily transferred to an intermediate transfer medium revolving in a fixed direction, said method wherein a monochromatic print mode and a color print mode are selectively executed; said monochromatic print mode being a print mode to form a monochromatic image by performing said image forming process using toner of a specific color, and to secondarily transfer the monochromatic image to a recording medium by making a secondary transfer device abut on said intermediate transfer medium; said color print mode being a print mode to form a color image by performing said image forming process each time one of said plural developing devices is selected to form plural toner images and then superimposing the plural toner images on top of each other on said intermediate transfer medium, and to secondarily transfer the color image to said recording medium by making said secondary transfer device to abut on said intermediate transfer medium, and a timing on when said secondary transfer device abuts on said intermediate transfer medium in said color print mode is different from said timing in said monochromatic print mode.

* * * * *

UNITED STATES PATENT AND TRADEMARK OFFICE

CERTIFICATE OF CORRECTION

PATENT NO. : 7,113,714 B2 
APPLICATION NO. : 10/956497
DATED : September 26, 2006
INVENTOR(S) : Taguchi et al.

It is certified that error appears in the above-identified patent and that said Letters Patent is hereby corrected as shown below:

On the Title Page, References Cited, after "6,078,777 A* 6/2000 Imumi et al. .....399/313"
add
**--5,790,930 A * 8/1998 Takashi Fuchiwaki.....399/302--**
and
**--5,671,464 A* 9/1997 Akira Kubota.....399/101--**

Signed and Sealed this

Twenty-seventh Day of March, 2007

JON W. DUDAS
*Director of the United States Patent and Trademark Office*